United States Patent [19]

Aoki

[11] 3,998,189

[45] Dec. 21, 1976

[54] FEEDBACK AIR-FUEL RATIO REGULATOR

[75] Inventor: Keiji Aoki, Susono, Japan

[73] Assignee: Toyota Jidosha Kogyo Kabushiki Kaisha, Toyota, Japan

[22] Filed: Oct. 20, 1975

[21] Appl. No.: 623,790

[30] Foreign Application Priority Data

May 28, 1975 Japan ..... 50-62847

[52] U.S. Cl. ..... 123/32 EA; 60/276; 431/90

[51] Int. Cl.[2] ..... F02D 3/00

[58] Field of Search ..... 123/32 EA; 60/285, 276; 431/12, 90

[56] References Cited

UNITED STATES PATENTS

| | | | |
|---|---|---|---|
| 3,738,341 | 6/1973 | Loos | 123/32 EA |
| 3,745,768 | 7/1973 | Zechwall | 60/276 |
| 3,782,347 | 1/1974 | Schmidt | 60/276 |
| 3,895,611 | 7/1975 | Endo | 123/32 EA |
| 3,910,240 | 10/1975 | Omori | 123/32 EA |

*Primary Examiner*—Ronald B. Cox

*Attorney, Agent, or Firm*—Woodhams, Blanchard and Flynn

[57] ABSTRACT

A feedback air-fuel ratio regulator comprises an air-fuel ratio sensor which determines air-fuel ratio of the combustible gas from the composition of its exhaust gas and produces a sudden change in its output at a preset theoretical air-fuel ratio and an electronic air-fuel ratio controlling circuit. The latter includes voltage detectors for detecting the output voltage of the air-fuel ratio sensor at two or more points corresponding to certain richer and leaner air-fuel ratios than the theoretical one. Switching means are actuated by the output combined by the voltage detectors. An integrating circuits has a time constant which is determined by a condenser and resistance selected by the switching means, whereby the amount of fuel to be injected is regulated by the time constant which is determined by the output of integrating circuit according to said output voltage.

9 Claims, 8 Drawing Figures

Vo
C
OP2
Ia
18
a
b
c
R5
R62
R61
R6
19
19b
Tr3
Tr5
D6
R12
D7
Tr4
D8
R11
D4
Tr2
D5
E
OP1
D1
OP5
OP6
OP3
OP4
K1
K4
K5
K2
K3
A/F
e
R65
R64
R63
20b
21b
22b
Vs
e<0.1, e>0.9VOLT
e<0.08, e>0.92 VOLT
e<0.07, e>0.93 VOLT
e<0.06, e>0.94 VOLT

FEEDBACK AIR-FUEL RATIO REGULATOR

FIELD OF THE INVENTION

The present invention relates to improvements in a feedback air-fuel ratio regulator which comprises an electronic circuit for controlling the amount of injected fuel as well as an air-fuel ratio sensor that determines air-fuel ratio of the combustible gas by detecting the content of oxygen in the exhaust gases of the engine in the exhaust gas cleaning equipment to reduce such toxic substances as hydrocarbons, carbon monoxide and nitrogen oxides which are usually present in the exhaust gases.

BACKGROUND OF THE INVENTION

The conventional feedback air-fuel ratio regulator of this type is so designed as to transmit a signal that changes with a certain time constant when the air-fuel ratio sensor has detected deviation of the air-fuel ratio from a preset theoretical value. Then, the amount of fuel to be injected is regulated so that the deviated air-fuel ratio is brought back again to the theoretical level by means of a signal transmitted from the electronic fuel injection controlling circuit into which the aforesaid signal and other compensating signals, such as one indicating the amount of sucked gas and one from the distributor for the spark plugs, are inputted.

Then, while fuel is injected into the intake air, the air-fuel ratio sensor is installed in a rather limited portion of its exhaust section. This entails a time-lag between the injection of fuel and the detection of air-fuel ratio that is equivalent to the sum of the time during which the sucked mixture is held within the cylinder and the time required for it to pass through the intake and exhaust passages. As a consequence, fuel has to be overinjected by such amount that corresponds to this time-lag, in excess of the amount required for attaining the theoretical air-fuel ratio, which is undesirable for the cleaning of exhaust gas. Said overinjection can be reduced by making the value of said time constant large. Then, however, it will take a considerable time for air-fuel ratio to return to its theoretical value subsequent to sudden change, impairing the response of the engine or the drive performance of the automobile.

The primary object of this invention is to provide a feedback air-fuel ratio regulator of the type which assures both a high drive performance and a good exhaust gas cleaning function by rapidly changing the amount of fuel injection with a small time constant until air-fuel ratio reaches the theoretical value, and reducing the amount of oversupply within the time-lag by automatically increasing said time constant after said theoretical air-fuel ratio has been attained.

DETAILED DESCRIPTION

Figure 1:
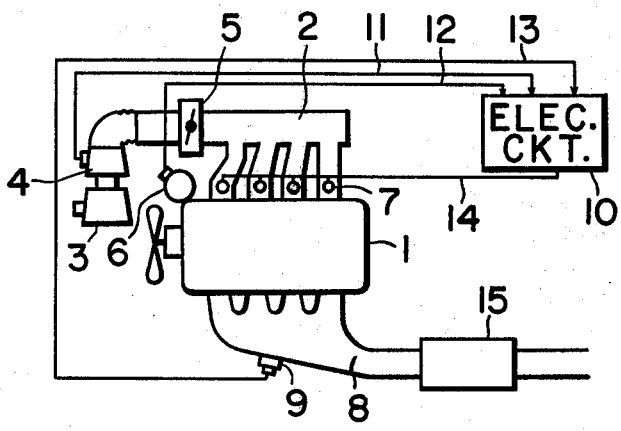
FIG. 1 is a schematic diagram showing the overall construction of a conventional feedback air-fuel ratio regulator.

How fuel injection is regulated in the conventional device will be described more concretely. In FIG. 1, reference numeral 1 designates an engine proper, 2 an intake manifold feeding air to the various cylinders, 3 an air cleaner fitted at the intake port of the intake manifold 2, 4 an air flow detector attached to the intake manifold 2, 5 a throttle valve for regulating the amount of air sucked, 6 a distributor for spark plugs, 7 a fuel injection nozzle, 8 an exhaust manifold, 9 an air-fuel ratio sensor, and 10 an electronic circuit for regulating fuel injection which receives electric input signals from the detector 4, distributor 6 and air-fuel ratio sensor 9 through signal lines 11, 12 and 13, respectively, and transmits instruction signals through a signal line 14 so that the appropriate amount of fuel is injected from the injection nozzle 7. Item 15 is a ternary catalytic converter of the known type that decomposes carbon monoxide, hydrocarbon and nitrogen oxides at the same time.

Figure 2:
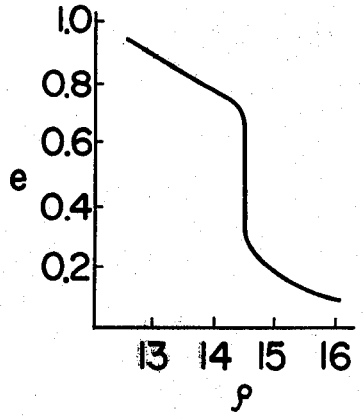
FIG. 2 shows a characteristic curve of an air-fuel ratio sensor.

FIG. 2 shown a known characteristic curve of the air-fuel ratio sensor 9, in which air-fuel ratio $\rho$ is plotted along the $x$-axis and output voltage $e$ of the air-fuel sensor is plotted along the $y$-axis, representing a characteristic that output voltage changes suddenly, for instance, from 0.2 volt to 0.6 to 0.7 volt in the proximity of the theoretical air-fuel ratio.

Figure 3:
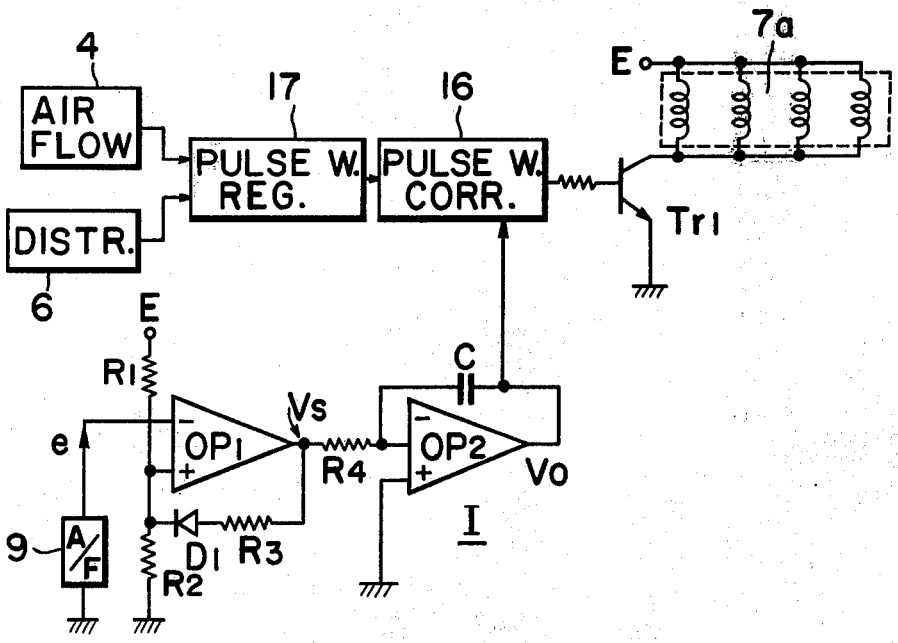
FIG. 3 is a block circuit diagram illustrating the principal part of an electronic circuit for controlling the amount of fuel injected in the conventional equipment.

FIG. 3 is a block circuit diagram of the electronical circuit 10. The output voltage $e$ of the air-fuel ratio sensor 9 is applied on the inversion input terminal of an operational amplifier $OP_1$, while a voltage equal to the output voltage of the air-fuel ratio sensor 9 at the theoretical air-fuel ratio (for instance, 0.5 volt in FIG. 2) is applied on the non-inversion input terminal thereof by dividing a constant voltage E with resistances $R_1$ and $R_2$. A resistance $R_3$ and a diode $D_1$ are positive feedback elements that impart hysteresis characteristic to the operational amplifier $OP_1$ so as to stabilize its operation.

An integrating circuit I, which is made up of an operational amplifier $OP_2$, a resistance $R_4$ and a condenser C, transmits an output Vo, which is obtained by timeintegrating the output voltage of the operational amplifier $OP_1$, to a pluse width correcting circuit 16.

Based on the signals from the detector 4 and the distributor 6, a pulse width regulating circuit 17 transmits such injection nozzle controlling pulse as may produce a mixture proportioned to the theoretical air-fuel ratio. In the pulse width correcting circuit 16, the width of said pulse is corrected with the output Vo, and then the corrected pulse actuates a drive solenoid 7*a* of the injection nozzle 7 through a power transistor $Tr_1$.

Let us assume that the non-inversion input voltage of the operational amplifier $OP_1$ is fixed at 0.5 volt so that judgement may be made that air-fuel mixture is rich when the output of the air-fuel ratio sensor 9 in FIG. 2 exceeds 0.5 volt and that it is lean when said output is lower than 0.5 volt. Then, when the aforesaid hysteresis phenomenon is omitted, output Vs of the operational amplifier $OP_1$ becomes inversed on both sides of $e = 0.5$ volt. If air-fuel mixture becomes lean and output $e$ falls to 0.1 volt due to some change in operating conditions, the operational amplifier $OP_1$ produces a high level step output Vs, and the output Vo of the operational amplifier $OP_2$ changes as expressed by the following equation:

$$Vo = -Vs\left(1 - e - \frac{t}{\tau}\right)$$

where $\tau = R_4C$

Figure 4:
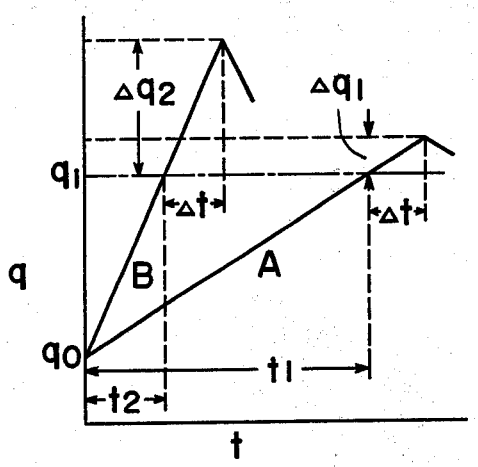
FIG. 4 shows changing characteristics of the amount of fuel injected.

The width of output pulse from the pulse width correcting circuit 16 increases in proportion to the output Vo, while the amount of fuel injected $q$ increases with time $t$, as represented by a curve A in FIG. 4. If $g_o$ in FIG. 4 is the amount of fuel required for attaining the theoretical air-fuel ratio under a certain steady operating condition, $q_1$ is the amount of fuel required after a change in the operating condition, and $\Delta t$ is the aforesaid time-lag, the amount of fuel oversupplied during a period of $\Delta t$ is $\Delta q_1$.

If the time constant $\tau$ is relatively larger as indicated by the curve A, the amount of oversupply $\Delta q_1$ becomes small, but it takes a long time $t_1$ to recover the theoretical air-fuel ratio, thereby impairing the drive performance. In contrast, if the time constant $\tau$ is made small to improve the drive performance, the amount of injection $q$ rapidly increases as indicated by a curve B and the time to recover the theoretical air-fuel ratio is reduced to $t_2$. However, the amount of oversupply $\Delta q_2$ within the time-lag $\Delta t$ increases, which, in turn, increases the contents of toxic substances in the exhaust gases and, therefore, lowers the cleaning performance of the catalytic converter 15.

As may be understood from the above, it is unavoidable that either of the drive performance or the cleanness of the engine exhaust should drop when the amount of fuel injection is change with a given time constant.

Figure 5:
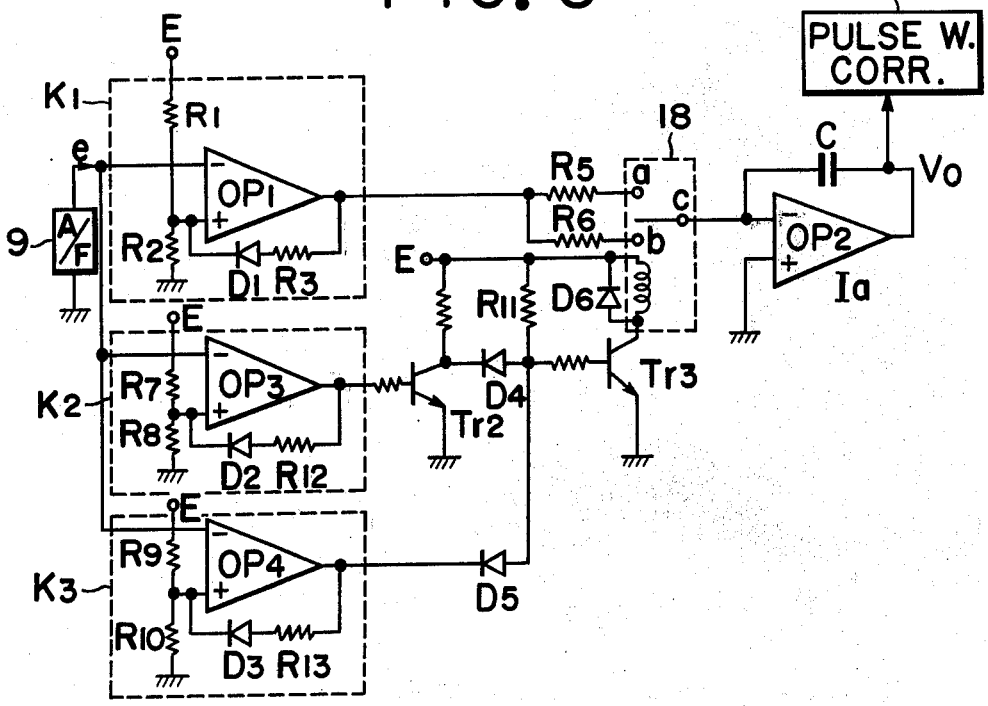
FIG. 5 is a block circuit diagram showing the principal part of an embodiment of this invention.

Now an embodiment of this invention will be described with reference to FIG. 5, in which reference numerals similar to those used in FIG. 3 designate similar parts. According to this invention, voltage detectors are provided for detecting voltages at two or more points that correspond to certain richer and leaner air-fuel ratios on the air-fuel ratio characteristic curve of FIG. 2. So, as illustrated in FIG. 5, voltage detectors $K_2$ and $K_3$, which include operational amplifiers $OP_3$ and $OP_4$, respectively, and possess the same circuit composition as a voltage detector $K_1$ that includes an operational amplifier $OP_1$, are provided. As in the case of FIG. 3, the operational amplifier $OP_1$ becomes inverted when the output $e$ of the air-fuel ratio sensor 9 reaches 0.5 volt (the hysteresis phenomenon being omitted, and the same for the individual operational amplifiers to be described hereinafter). Also, resistances $R_7$ to $R_{10}$ are so selected that the operational amplifiers $OP_3$ and $OP_4$ will be inversed when the output $e$ reaches 0.2 volt and 0.8 volt, respectively.

A transistor $Tr_2$ constitutes a NOT circuit that makes the output of the operational amplifier $OP_3$ inversed. Diodes $D_4$ and $D_5$ and a resistance $R_{11}$ constitute an AND circuit that inputs the output of said NOT circuit and the output of the operational amplifier $OP_4$. When a transistor $Tr_3$ conducts an application of the output from said AND circuit, it energizes a switching relay 18. On being energized, the switching relay 18 closes contacts $a$ and $c$, thereby connecting a resistance $R_5$ to a condenser C. On being deenergized, contacts $b$ and $c$ are closed to connect a resistance $R_6$ ($<R_5$) to the condenser C.

If the output $e$ of the air-fuel ratio sensor 9 is 0.2 volt$< e<$0.8 volt, air-fuel ratio almost approximates the theoretical value, then the output of the operational amplifier $OP_3$ is inverted to negative and the transistor $Tr_2$ becomes nonconductive. Because its collector potential becomes positive then, and the output of the operational amplifier $OP_4$ also is positive, said AND circuit produces output, the transistor $Tr_3$ is caused to become saturated, and the relay 18 is energized to close the contacts $a$ and $c$.

If the output of $e<0.2$ volt, the operational amplifiers $OP_3$ and $OP_4$ are in an non-inversed state, the transistor $Tr_2$ conducts and its collector potential drops to ground, and the AND circuit produces no output. When the output $e>0.8$ volt, the operational amplifier $OP_4$ becomes inversed, and therefore the AND circuit produces no output, similarly. Therefore, when $e<0.2$ volt and when $e>0.8$ volt, the transistor $Tr_3$ does not conduct, and the relay 18 is deenergized to close the contacts $b$ and $c$.

Figure 6:
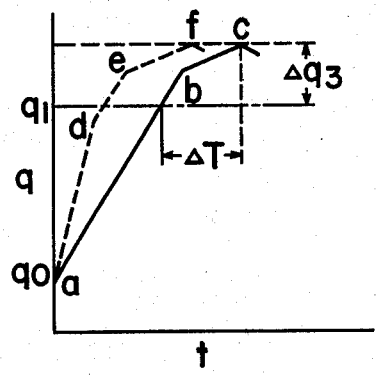
FIG. 6 shows changing characteristics of the amount of fuel injected in the embodiment of this invention.

Since $R_5>R_6$, the time constant $R_5C$ required for the output of an integrating circuit I$a$ to change is large when 0.2 volt $<e<$0.8 volt. While the time constant $R_6C$ for the cases in which $e<0.2$ volt and $e>0.8$ volt is small. Accordingly, if air-fuel ratio changes in the proximity of its theoretical value, the amount of fuel injected changes with a large time constant as indicated by the curve A of FIG. 4, thus reducing oversupply. When air-fuel ratio deviates greatly from its theoretical value, the amount of fuel injected first changes rapidly with a small time constant as indicated by the curve B of FIG. 4. Then, when it approaches $q_1$ that corresponds to the theoretical air-fuel ratio and the output $e$ falls between 0.2 volt and 0.8 volt (0.2 volt $<e<$0.8 volt), the time constant becomes larger and the amount of fuel injected $q$ changes at the same rate as that of the curve A. That is, the amount of fuel injected $q$ changes as indicated by a solid curve *a-b-c* in FIG. 6, and the amount of oversupplied fuel $\Delta q_3$ within the time-lag $\Delta t$ is decreased.

In the above-described embodiment, the output $e$ of the air-fuel ratio sensor 9 detected for the rich air-fuel ratio and the lean air-fuel ratio is one each, and the output $e$ thus detected is treated with one resistance $R_5$. But it is also possible to provide three or more voltage detectors so as to detect a plurality of outputs $e$ for each of the rich and lean air-fuel ratios. By actuating a plurality of switching relays by combining the outputs of these voltage detectors, the time constant of the integrating circuit I$a$ may be changed in three steps or more. By this means, the curve *a-b-c* of FIG. 6 may be bent more closely, so that drive performance is improved and the amount of oversupplied fuel $\Delta q_3$ is decreased.

Figures 7, 8:
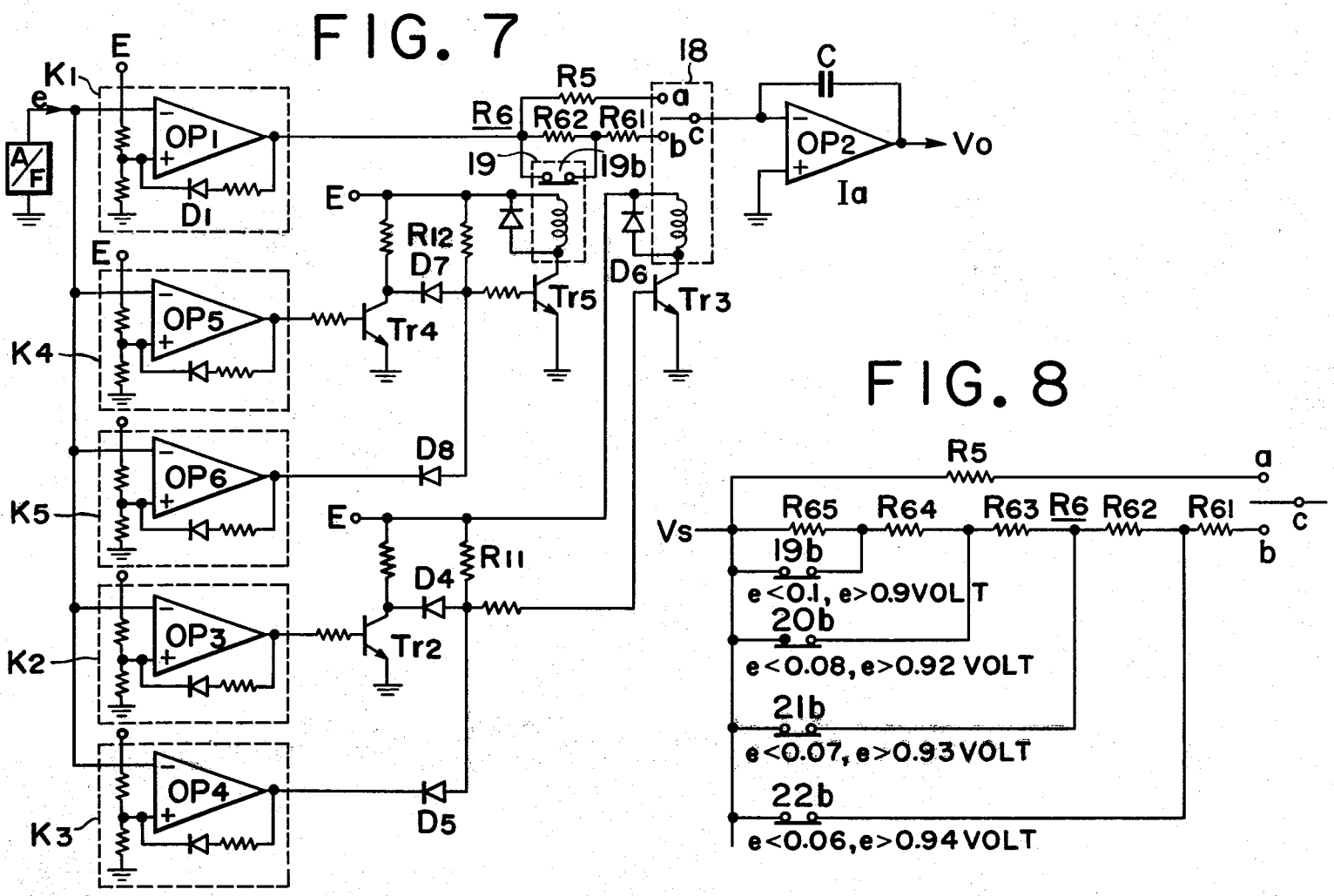
FIG. 7 is a block circuit diagram of the principal part of another embodiment.
FIG. 8 is a diagram of the resistance switching circuits of still another embodiment.

FIG. 7 exemplifies a circuit in which two each voltage detectors $K_2$ and $K_3$, and $K_4$ and $K_5$ are provided for the rich air-fuel ratio and the lean air-fuel ratio, respectively. In this figure, reference numerals similar to those used in FIG. 5 designate similar parts, and the voltage detectors $K_4$ and $K_5$ are constructed in the same way as $K_2$ and $K_3$, except that the output of $K_4$ becomes inversed when, for example, $e<0.1$ volt and that of $K_5$ when $e>0.9$ volt.

In this circuit, the contacts *b* and *c* are closed as described previously when air-fuel ratio deviates greatly from the theoretical value and the output *e* becomes lower than 0.1 volt ($e<0.1$ volt). At the same time, however, the outputs of $K_4$ and $K_5$ are not inversed, and a transistor $Tr_4$ conducts. Consequently a second AND circuit, composed of diodes $D_7$ and $D_8$ and a resistance $R_{12}$, does not produce output as described previously. When the output $e \geq 0.9$ volt, the contacts *b* and *c* are closed as described before, and the output of $K_5$ is inversed to negative. Therefore, said second AND circuit produces no output this time, too. Therefore, when the output $e<0.1$ volt and $e>0.9$ volt, a transistor $Ir_5$ does not conduct, a relay 19 is deenergized, and its normally closed contact 19*b* short-circuits part $R_{62}$ of a resistance $R_6$. Then, only part $R_{61}$ of the resistance $R_6$ remains effective, and the time constant of the integrating circuit I*a* is reduced to $R_{61}C$.

As a consequence, the amount of fuel injected *q* changes rapidly with the time constant $R_{61}C$. Then, if the output *e* falls between 0.1 volt and 0.2 volt (0.1 volt $<e<0.2$ volt) or between 0.8 volt and 0.9 volt (0.8 volt$<e<0.9$ volt), said second AND circuit produces output, the transistor $Tr_5$ conducts, and the relay 19 becomes energized to open the contact 19*b*. Then, the time constant of the integrating circuit I*a* increases to $R_6C$, and the amount of fuel injected is regulated as described previously with reference to FIG. 5. With the output *e* between 0.2 volt and 0.8 volt (0.2 volt$<e<0.8$ volt), detectors $K_4$ and $K_5$ continue to hold contact 19*b* open, but as discussed with respect to FIG. 5, detector $K_2$ inverts, transistor $Tr_2$ is off, its AND circuit produces output, transistor $Tr_3$ energizes relay 18 and switch contacts *a* and *c* are closed, giving the large time constant $R_5C>R_6C$. A broken curve *a-d-e-f* of FIG. 6 indicates an increase in the amount of fuel injecteed *q* that is regulated as described above.

FIG. 8 shows a switching circuit for a number of resistances R that are intended for still closer, or more finely divided, regulation of time constant for changing the amount of fuel injected, in a system that provides still greater number of voltage detectors and switching relays for each of the rich air-fuel ratio and the lean air-fuel ratio. The regulating principle of this circuit is the same as that of the circuit shown in FIG. 7.

According to this invention that is composed as described hereabove, drive performance of the engine can be maintained satisfactory even when air-fuel ratio of its charge deviates greatly from the theoretical value, by rapidly changing the amount of fuel injected therein. Then, as the air-fuel ratio is brought back to the theoretical value by such regulation, the amount of fuel injection is decreased to hold down oversupply of fuel. By this means, increase of the toxic substances in the exhaust gases can be prevented, and the catalytic converter is allowed to perform its exhaust gas cleaning function to the fullest possible extent.

The embodiments of the invention in which an exclusive property or privilege is claimed are defined as follows:

1. In combination with an internal combustion engine, a feedback air-fuel ratio regulator comprising an air-fuel ratio sensor which determines air-fuel ratio of a combustible gas from the composition of the engine exhaust gas and produces a sudden change in its output at a preset theoretical air-fuel ratio, and an electronic air-fuel ratio controlling circuit including voltage detectors for detecting output voltage of the air-fuel ratio sensor at two or more points corresponding to certain richer and leaner air fuel ratios than the theoretical one, switching means actuated by the output of the voltage detectors, and an integrating circuit having a time constant determined by a condenser and a resistance selected by the switching means, whereby the amount of fuel to be injected is regulated by the output of the integrating circuit which in turn is determined by selection of said time constant in accordance with said voltage.

2. The apparatus of claim 1 in which said integrating circuit includes a time constant network including said condenser and a plurality of resistances selectable by said switching means to provide at least two integrating circuit time constants, the number of said time constants and of said points being no more than the number of said voltage detectors.

3. The apparatus of claim 1 including a further voltage detector for detecting output voltage of the air-fuel ratio sensor at a point corresponding to the preset theoretical air-fuel ratio, the output of said further voltage detector being connected to said integrating circuit through the said resistance selected by said switching means, such that said integrating circuit increases or decreases the air-fuel ratio according to the output of said further voltage detector and at a rate in accord with the time constant determined by the particular one of several resistances selected.

4. The apparatus of claim 1 in which said voltage detectors comprise first and second voltage detectors which respectively change output at the lower and higher ends of an air-fuel ratio range straddling said preset theoretical air-fuel ratio, and including logic circuit means responsive to the output of said voltage detectors when the sensed air-fuel ratio is within said range for causing said switching means to select a long time constant and when said sensed air-fuel ratio is outside said range to select a shorter time constant, whereby when the sensed air-fuel ratio is near said theoretical fuel ratio the amount of fuel supplied is changed slowly and when the sensed air-fuel ratio substantially differs from said theoretical air-fuel ratio the amount of fuel supplied is changed rapidly.

5. The apparatus of claim 4 in which said first and second voltage detectors invert the outputs thereof as the sensed air-fuel ratio rises respectively above said lower and higher ends of said range, said logic circuit means comprising an invertor at the output of said first voltage detector and an AND-gate having inputs coupled to the output of said invertor and the output of said second voltage detector, whereby said AND-gate provides an output when the sensed air-fuel ratio is within said range.

6. The apparatus of claim 5 in which said switching means comprises a transistor actuable by an output from said AND-gate, a two-position switch connected to the input of said integrating circuit and to a resistance network for coupling a different resistance value to the input of said integrating circuit in each of its switchable positions, and a relay device responsive to the state of said transistor for correspondingly positioning said two-position switch.

7. The apparatus of claim 1 including plural pairs of said voltage detectors, the voltage detectors of each said pair respectively providing a change in output at opposite end points of a range of air-fuel ratios, in which range said theoretical air-fuel ratio is substantially centered, the ends of each such range being respectively leaner and richer than said theoretical air-fuel ratio, said range of each successive said pair of voltage detectors being wider than and encompassing the range of the preceding said pair, said integrating circuit having a time constant network having a plurality of time constant determining elements, including said resistance and capacitance, a said switching means responsive to each said voltage detector pair, each said switching means being arranged to effectively connect or disconnect a said time constant element in said network to change the time constant of said integrating circuit, logic means interconnecting each said voltage detector pair with its associated switching means for causing the latter to select a shorter time constant when the sensed air-fuel ratio is outside the range of the respective voltage detector pair and to select a longer time constant when the sensed air-fuel ratio is within the range of such voltage detector pair, whereby the amount of fuel injected can be rapidly varied where the sensed air-fuel ratio greatly deviates from the theoretical air-fuel ratio and progressively more slowly varied as the sensed air-fuel ratio approaches the theoretical one.

8. The apparatus of claim 7 in which said network comprises a first relatively high resistance and, in parallel therewith, a series of resistances totaling a lower resistance value, a first said switching means being responsive to a first said voltage detector pair having the smallest said range and comprising a double throw switch having a movable contact connected to the input of said integrating circuit, said double throw switch having a first contact selectable when the sensed air-fuel ratio is within the range of said first voltage detector pair and connected to said relatively large resistance, said double throw switch having a second contact selectable when said sensed air-fuel ratio is outside said range of said first voltage detector pair and connected to said series of resistance, the switching means of successive remaining ones of said voltage detector pairs comprising single throw switches connected across successively larger groups of said series of resistances, each said further switching means being closed to partially reduce the resistance value of said series of resistances only when the sensed air-fuel ratio is outside the range of the corresponding voltage detector pair, so as to progressively increase said integrating circuit time constant and progressively decrease the rate of change of fuel input as the sensed air-fuel ratio changes toward said theoretical air-fuel ratio and thereby minimize the amount of fuel oversupply due to time lag between a given fuel input and detection of the resulting air-fuel ratio.

9. In combination with an internal combustion engine feedback air-fuel ratio regulator for controlling the amount of fuel input into air for said engine, and comprising:

air-fuel ratio sensor means associated with said engine for sensing the air-fuel ratio of a combustible air-fuel mixture and for producing a sudden change in sensor output at a preset theoretical air-fuel ratio:

voltage detector means responsive to shifting of said air-fuel sensor means output past each of at least two different points corresponding respectively to preselected richer and leaner air-fuel ratios than the theoretical air-fuel ratio for producing corresponding changes in output signals from said voltage detector means;

means responsive to said air-fuel sensor means and having an output for regulating the amount of fuel to be supplied to said engine and further having time constant means controlling the rate of change of fuel input and responsive to said voltage detector output signal changes for varying fuel input rate with a short time constant when the sensed air-fuel ratio deviates widely from the theoretical one and for varying the rate of fuel input with a longer time constant as the sensed air-fuel ratio approaches said theoretical one.

* * * * *